US005176608A

United States Patent [19]

Wakabayashi et al.

[11] Patent Number: 5,176,608

[45] Date of Patent: Jan. 5, 1993

[54] CONTAINER BLANK ERECTER AND FEEDER

[75] Inventors: Shigeru Wakabayashi; Shoji Hirose; Shoji Nishioka; Yasuji Fujikawa, all of Tokushima, Japan

[73] Assignee: Shikoku Kakoki Co., Ltd., Itano, Japan

[21] Appl. No.: 811,431

[22] Filed: Dec. 23, 1991

[30] Foreign Application Priority Data

Dec. 25, 1990 [JP] Japan ..... 2-401576[U]

[51] Int. Cl.[5] ..... B31B 5/80; B31B 5/32

[52] U.S. Cl. ..... 493/125; 493/316

[58] Field of Search ..... 493/122, 125, 313, 316, 493/317

[56] References Cited

U.S. PATENT DOCUMENTS

| | | | |
|---|---|---|---|
| 3,418,894 | 12/1968 | Jivoin | 493/309 |
| 3,750,931 | 8/1973 | Dick | 493/316 |
| 3,896,711 | 7/1975 | Vuilleumier | 493/316 |
| 4,213,285 | 7/1980 | Mancini | 53/137 |
| 4,512,756 | 4/1985 | Fields | 493/312 |
| 4,708,707 | 11/1987 | Koike et al. | 493/313 |
| 5,007,889 | 4/1991 | Wakabayashi et al. | 493/316 |

FOREIGN PATENT DOCUMENTS

| | | | |
|---|---|---|---|
| 0339178 | 11/1989 | European Pat. Off. . | |
| 127226 | 5/1990 | Japan | 53/52 |

*Primary Examiner*—William E. Terrell

*Attorney, Agent, or Firm*—Armstrong & Kubovcik

[57] ABSTRACT

A blank feeder is disclosed having a magazine with a delivery opening at one end and accommodating flat blanks as arranged from the one end toward the other end thereof in the form of a stack. The blank feeder also has a transport device having a path of transport extending straight from the delivery opening as a starting end to a terminal end away from the opening, and a device for unfolding each of the flat blanks to a tubular form of square cross section while the blank is being transported by the transport device. The unfolding device has first and second blank unfolding claws provided at edge portions of the delivery opening so as to be individually engageable with opposite ends of the blank in the delivery opening. The first and second unfolding claws are positioned at different distances from a reference plane orthogonal to the transport path in a direction along the path.

4 Claims, 6 Drawing Sheets

CONTAINER BLANK ERECTER AND FEEDER

BACKGROUND OF THE INVENTION

The present invention relates to an apparatus for use with blanks which are folded flat so as to be unfoldable to a tubular form of square cross section for feeding each of the blanks to a bottom forming mandrel by unfolding the blank to the tubular form and fitting the unfolded blank around the mandrel.

FIG. 6 shows a conventional apparatus of the type mentioned which comprises a magazine 62 having a delivery opening 61 at one end for accommodating flat blanks B as arranged side by side from the end toward the other end thereof, transport means having a path of transport extending from the delivery opening 61 as a starting end and a transport rod 64, the transport rod 64 having a suction member 63 attached to the forward end thereof and reciprocatingly movable on a straight line orthogonal to the blank B in the delivery opening 61, and means for unfolding each flat blank B to a tubular form of square cross section while the blank is being transported by the transport means, the unfolding means having first and second unfolding claws 65, 66 provided at edge portions of the delivery opening 61 so as to be individually engageable with opposite ends of the blank B in the delivery opening 61.

With the conventional apparatus, the blank B which is to be unfolded to the tubular form is likely to be bent in two in cross section instead. The cause appears to be as follows. Since the blank B moves on the straight line while being transported by the transport means, opposite ends of the blank move at the same velocity. When the blank B is delivered from the delivery opening 61, the opposite ends of the blank B move at the same speed to come into engagement with the respective unfolding claws 65, 66 at the same time, whereby the blank is unfolded to the same extent by the two claws. After the blank has been unfolded to some extent, the blank ends move out of engagement with the two claws 65, 66 at the same time, with the result that the unfolded blank B restores itself to the original flat state owing to its own repulsive force and further becomes bent to <-shape in cross section.

SUMMARY OF THE INVENTION

The main object of the present invention is to provide a blank feeder which is capable of reliably unfolding flat blanks to a tubular form of square cross section without bending the blank to the above shape.

The present invention provides a blank feeder which comprises a magazine having a delivery opening at one end and accommodating flat blanks as arranged from the above-mentioned end toward the other end thereof in the form of a stack, transport means having a path of transport extending straight from the delivery opening as a starting end to a terminal end away from the opening, and means for unfolding each of the flat blanks to a tubular form of square cross section while the blank is being transported by the transport means, the unfolding means having first and second blank unfolding claws provided at edge portions of the delivery opening so as to be individually engageable with opposite ends of the blank in the delivery opening. The first and second unfolding claws are positioned at different distances from a reference plane orthogonal to the transport path in a direction along the path. When the blank to be transported is withdrawn from the magazine by the transport mean, the opposite ends of the blank are brought out of engagement with the respective first and second unfolding claws at different times in corresponding relation with the different distances from the plane, as when they are engaged by the claws. Accordingly, the blank does not act to restore the original flat state without the likelihood of being folded in two in cross section. The blank can therefore be unfolded to the tubular form properly.

DESCRIPTION OF THE PREFERRED EMBODIMENT

Figure 1:
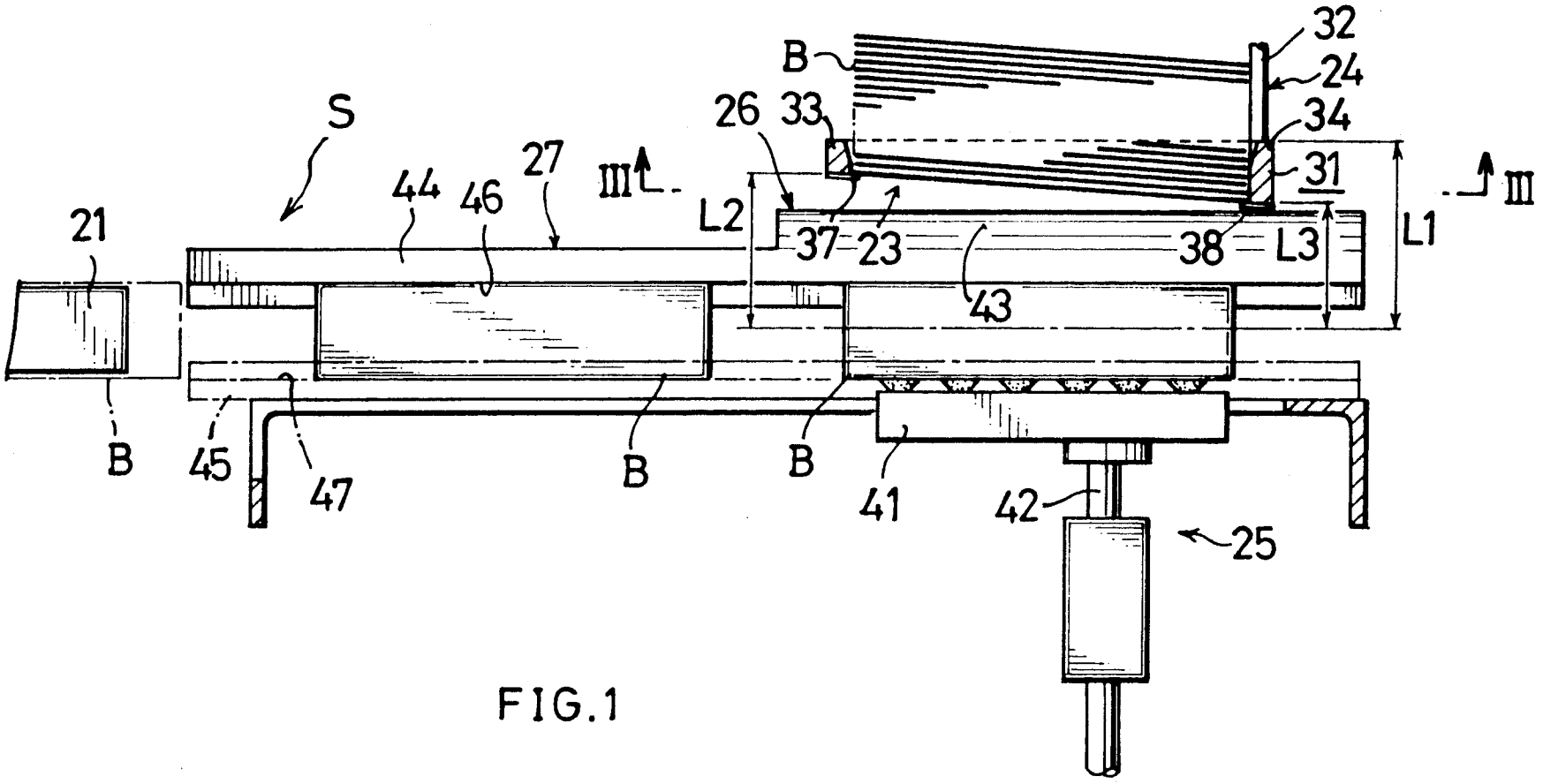
FIG. 1 is a side elevation of a blank feeder embodying the invention.
Figure 2:
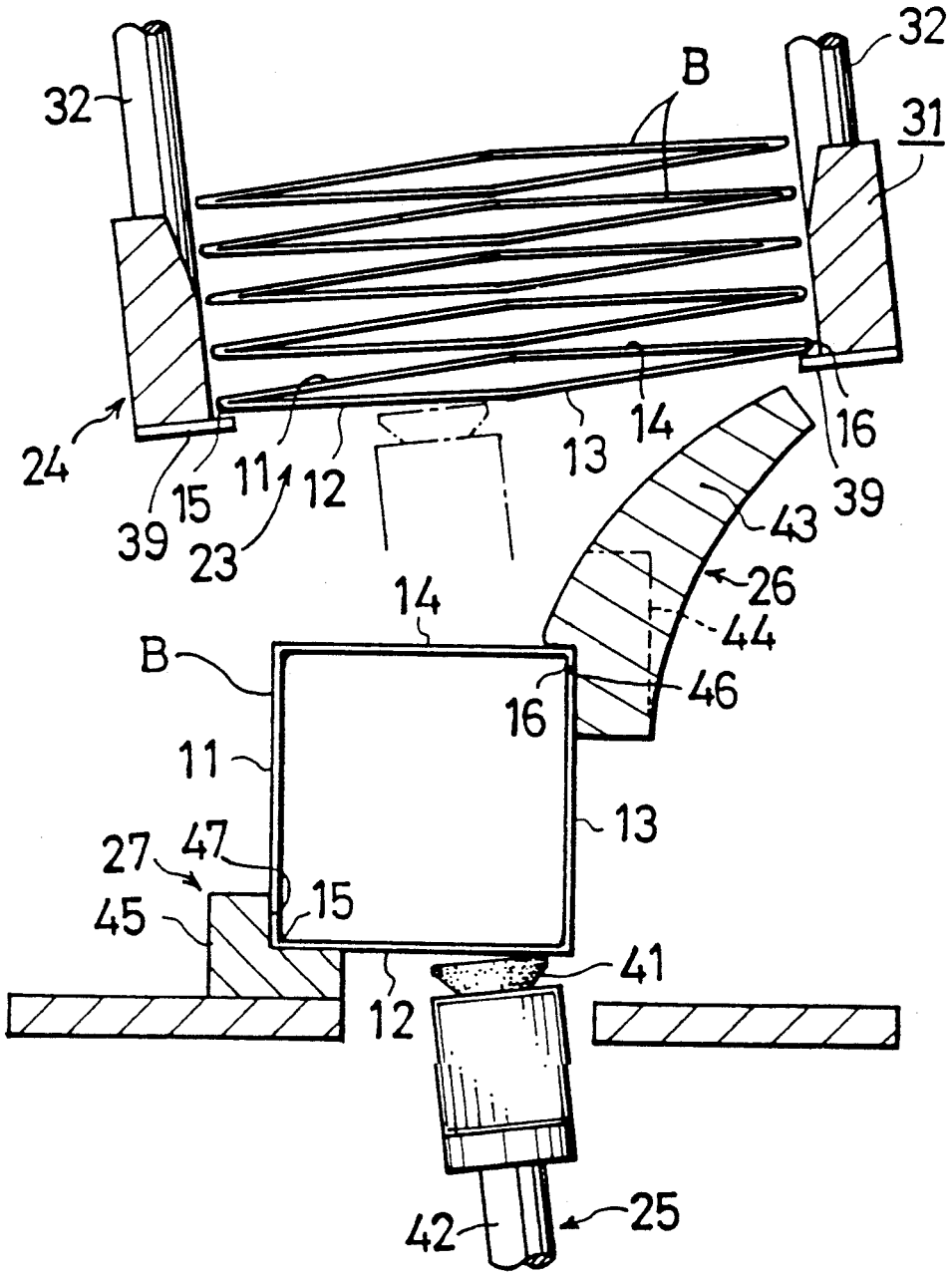
FIG. 2 is a view in vertical section of the feeder.

An embodiment of the invention will be described below with reference to the drawings.

In the following description, the terms "inward" and "outward" are used based on FIG. 1. The left-hand side of the drawing will be referred to as "inward," and the right-hand side thereof as "outward." Further the terms "right" and "left" are used as the feeder is seen outward.

Figure 5:
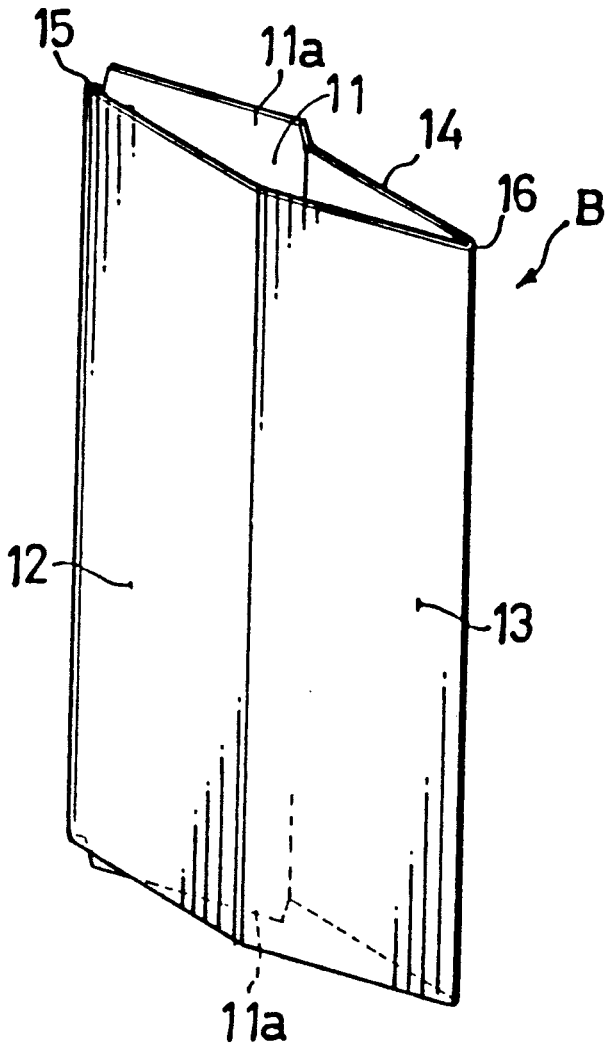
FIG. 5 is a perspective view of a blank.
Figure 6:
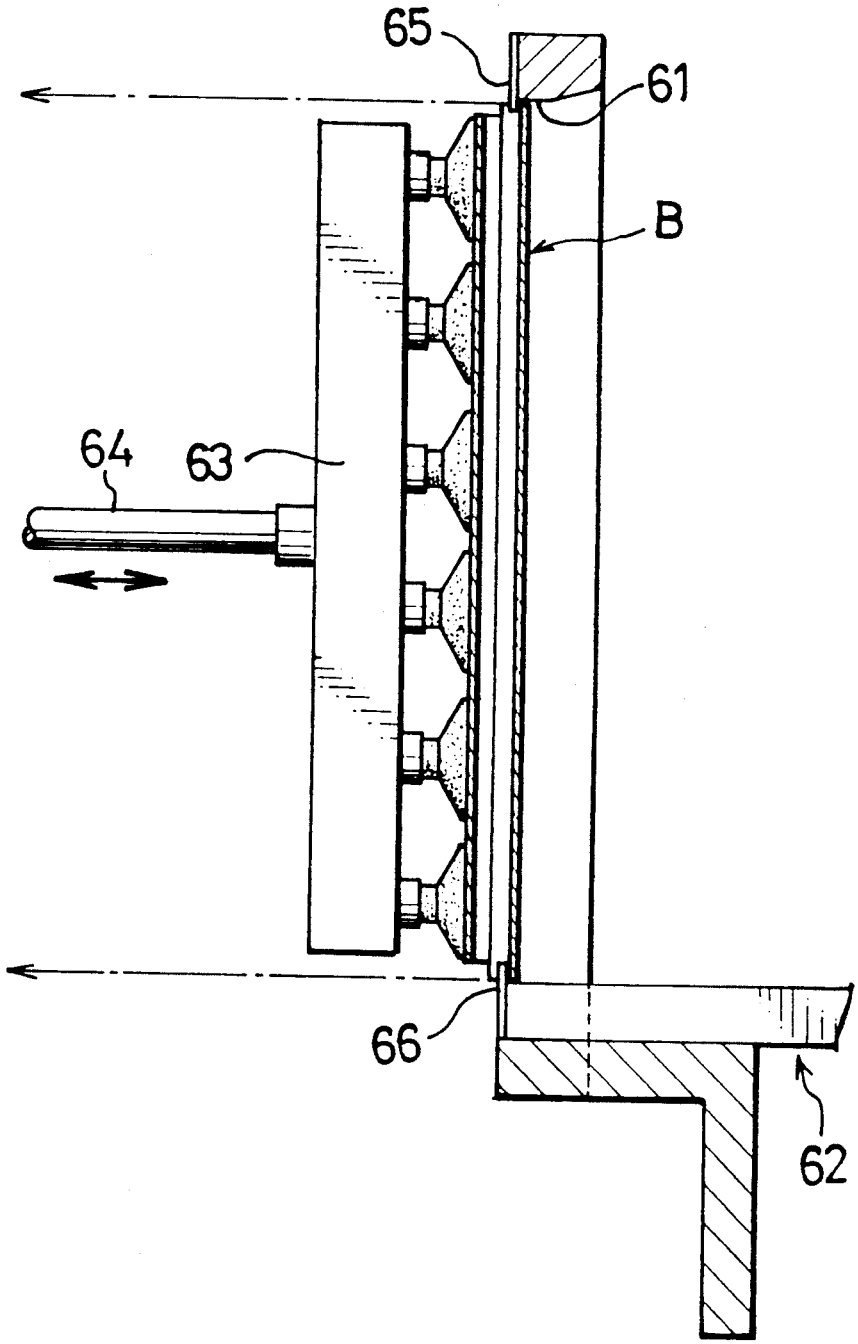
FIG.6 PRIOR ART
FIG. 6 is a diagram for illustrating the blank unfolding operation of a conventional feeder.

FIG. 5 shows a blank B having first to fourth side panels 11 to 14 which are joined to one another endlessly. The blank B is folded flat so as to be unfoldable to a tubular form of square cross section, by being bent along a first score 15 defining the first side panel 11 and the second side panel 12, and along a second score 16 defining the third side panel 13 and the fourth side panel 14. The first side panel 11 is provided at its opposite ends with engageable portions 11*a* for engagement with the blank unfolding claws to be described later. The engageable portions 11*a* project outward beyond the respective ends of the second side panel 12.

With reference to FIG. 1 showing a blank feeder, the feeder comprises a magazine 24 disposed above a phantom line extending outward from a blank bottom forming mandrel 21 stopped at a feed station S. The magazine 24 has a downward delivery opening 23 at its lower end and has accommodated therein a multiplicity of flat blanks B stacked up and arranged from the lower end toward the upper end thereof, with the length of the blanks B in parallel to the phantom line. The blank feeder further comprises transport means 25 for withdrawing the blank B from the magazine 24 one by one and transporting the blank onto the phantom line, unfolding means 26 for unfolding the flat blank B to the tubular form of square cross section while the blank is being transported by the means 25, and a holder 27 for holding the unfolded blank B on the phantom line.

Within the magazine 24, each blank B is so positioned that the second side panel 12 and the third side panel 13 face toward the delivery opening 23, with the second side panel 12 at the left side of the third side panel 13.

Figure 3:
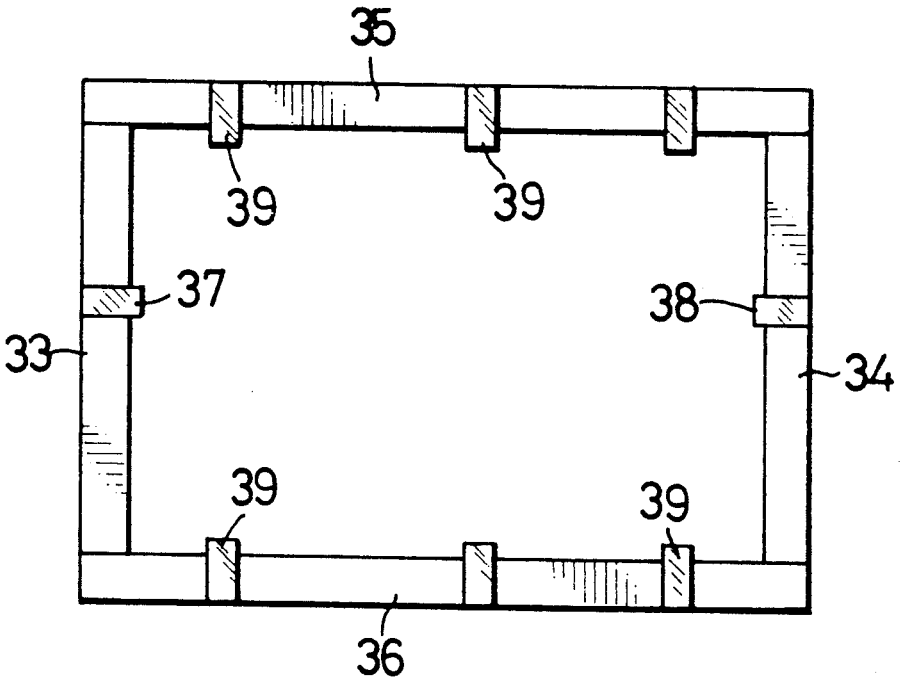
FIG. 3 is a view of the same as it is seen in the direction of arrows III—III in FIG. 1.

The magazine 24 comprises a vertical rectangular frame 31 defining the delivery opening 23, and a multiplicity of guide rails 32 extending upward from the frame 31. With reference to FIG. 3, the frame 31 comprises inner and outer frame members 33, 34 arranged in parallel to each other and space apart by a distance approximately equal to the length of blanks B, and left and right frame members 35, 36 each connected between the corresponding ends of the inner and outer frame members 33, 34, arranged in parallel to each other and spaced apart by a distance approximately equal to the width of blanks B.

With reference to FIG. 1, the inner and outer frame members 33, 34 are different in vertical thickness. The top surfaces of the inner and outer frame members 33, 34 are at the same distance L1 from the phantom line extending outward from the mandrel 21, whereas the distance L2 from the phantom line to the bottom surface of the inner frame member 33 is larger than the distance L3 from the phantom line to the bottom surface of the outer frame member 34. A first blank unfolding claw 37 is attached to the bottom of the inner frame member 33, and the second blank unfolding claw 38 to the bottom of the outer frame member 34. When seen sideways, the left and right frame members 35, 36 are tapered inward so as to smoothly interconnect the corresponding ends of the inner and outer frame members 33, 34. The left and right frame members 35, 36 are provided at a plurality of locations on their bottom side with blank supports 39 for the first and second score portions 15, 16 of the blank B, i.e., left and right edge portions thereof, to bear on.

The transport means 25 comprises a suction member 41 for attracting thereto the second side panel 12 of the blank B in the magazine 24, and a transport rod 42 having the suction member 36 attached to its forward end and reciprocatingly movable in a direction intersecting the phantom line extending outward from the mandrel 21.

The unfolding means has, in addition to the unfolding claws 37, 38, a bent guide 43 for guiding to the holder 27 the second score portion 16 of the blank B being transported by the transport means 25 while pushing the score portion leftward. The bent guide 43 comprises a curved plate extending obliquely leftwardly downward from a position close to the right frame member 36 of the magazine 24 toward the holder 27.

The holder 27 comprises upper and lower guide rails 44, 45 extending on opposite sides of the phantom line extending outward from the mandrel 21 in parallel thereto. The guide rails 44, 45 are formed with opposed recesses 46, 47 V-shaped in cross section in conformity with the respective corners of the unfolded tubular blank B along the first and second scores 15, 16 thereof. The bent guide 43 is integral with the upper guide rail 44.

Figure 4A:
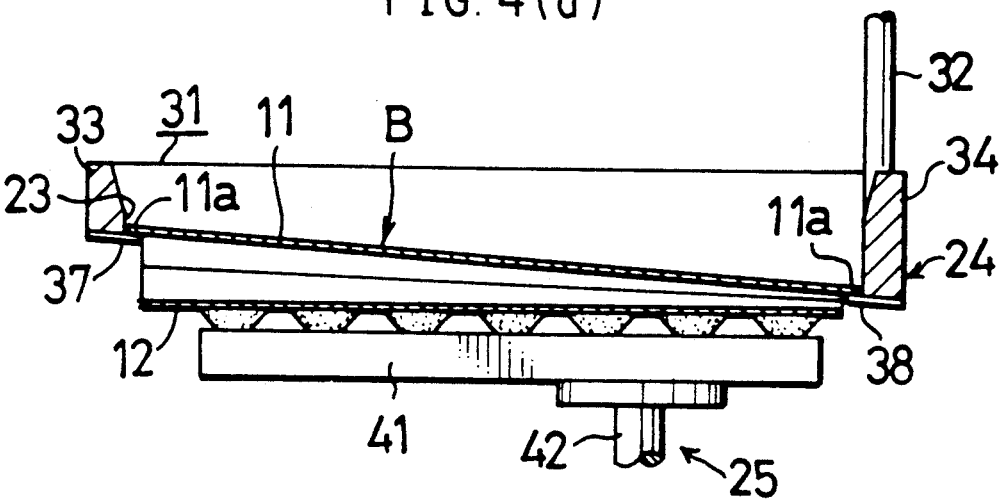
FIG. 4(*a* and *b*) is a diagram for illustrating a blank unfolding operation.
Figure 4B:
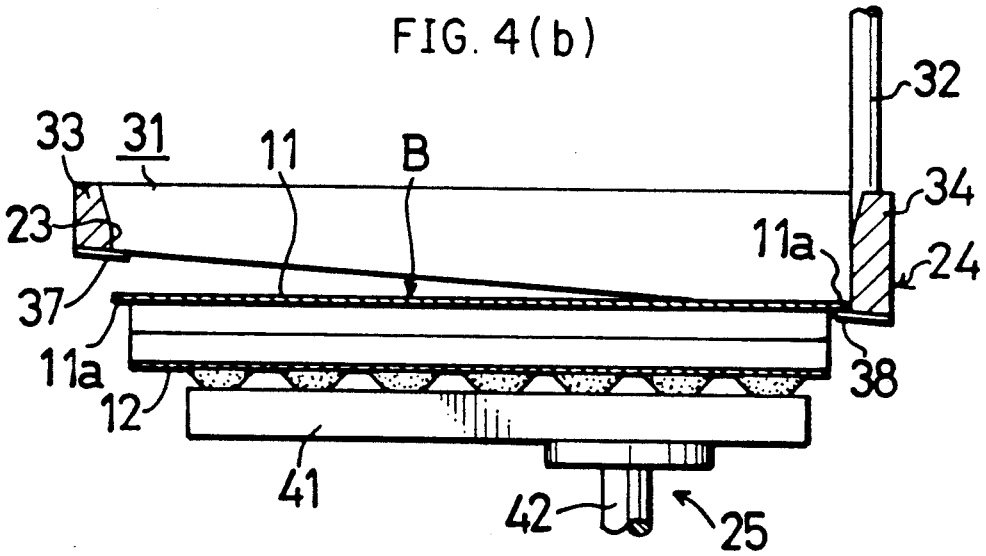

The blank unfolding operation will be described next with reference to FIG. 4. When the blank B is withdrawn from the delivery opening 23 of the magazine 24, the engageable portion 11*a* at the inner end of the blank B first engages with the first unfolding claw 37 (FIG. 4, (*a*)), and the engageable portion 11*a* at the outer end of the blank B then engages with the second unfolding claw 38, whereby the blank ends are gradually unfolded. In this case, the inner end of the blank B is opened to a greater extent than the outer end thereof. The engageable portion 11*a* at the inner end of the blank B then moves out of engagement with the first unfolding claw 37 (FIG. 4, (*b*)). At this time, the blank B acts to bend to a <-shape in cross section owing to its repulsive force, whereas the engageable portion 11*a* at the outer end of the blank B remains engaged by the second unfolding claw 38, whereby the blank B is prevented from bending to the above shape. The outer-end engageable portion 11*a* of the blank B is thereafter released from the second claw 38, permitting the blank B to be unfolded to a tubular form of square cross section.

What is claimed is:

1. A blank feeder for feeding blanks to a bottom forming mandrel each blank folded flat so as to unfold to a tubular form of square cross section and so as to fit the unfolded blank around the mandrel, the feeder comprising:

a magazine having a delivery opening at one end and accommodating flat blanks as arranged from said one end toward the other and thereof in the form of a stack, transport means having a path of transport extending straight from the delivery opening as a starting end to a terminal end away from the opening, means for unfolding each of the flat blanks to the tubular form while the blank is being transported by the transport means, the unfolding means having first and second blank unfolding claws provided at edge portions of the delivery opening so as to individually engage with opposite ends of the blank in the delivery opening and separate and open said opposite ends of the blank, the first and second unfolding claws being positioned at different distances from a reference plane orthogonal to the transport path in a direction along the path, and means for feeding the unfolded blank to the bottom forming mandrel to fit the unfolded blank around the mandrel.

2. A blank feeder as defined in claim 1 wherein the transport means comprises a suction member and a transport rod having the suction member attached to one end thereof and reciprocatingly movable along the path of transport.

3. A blank feeder as defined in claim 1 wherein the terminal end of the transport path of the transport means coincides with a phantom line extending outward from the mandrel, and guide rails for guiding the unfolded blank to the mandrel are arranged on the phantom line, the unfolding means being provided with a bent guide for guiding from the delivery opening to the guide rails one of folded edge portions of the blank being unfolded from the flat form to the tubular form.

4. A blank feeder as defined in claim 1 wherein the magazine is so disposed as to cause the delivery opening to be opposed to the phantom line from above and to accommodate the blanks with opposite ends thereof oriented inward and outward, the magazine having a frame defining the delivery opening; the frame including an inner frame member having the first unfolding claw and an outer frame member having the second unfolding claw, the upper surfaces of the inner and outer frame members being at the same distance from the reference plane, the inner and outer frame members being different from each other in vertical thickness by the difference between said different distances.

* * * * *